US005722872A

United States Patent [19]

Simmons et al.

[11] Patent Number: 5,722,872

[45] Date of Patent: Mar. 3, 1998

[54] COUNTER BALANCED LIFT ASSEMBLY FOR LOW-RIDER MODEL VEHICLES

[76] Inventors: Donald Simmons, 8032 Ney Ave.; Larnell Simmons, 3236 M.L.K. Jr. Way, both of Oakland, Calif. 94605

[21] Appl. No.: 649,840

[22] Filed: May 16, 1996

[51] Int. Cl.[6] ..... A63H 30/04; A63H 17/26

[52] U.S. Cl. ..... 446/456; 446/466; 280/43.23

[58] Field of Search ..... 446/454, 456, 446/465, 466, 462, 460, 470, 471, 431; 280/43.23, 43.19, 43.17; 180/24.02

[56] References Cited

U.S. PATENT DOCUMENTS

| | | | |
|---|---|---|---|
| 3,544,127 | 12/1970 | Dobson | 280/43.17 |
| 3,596,401 | 8/1971 | Camire | 446/462 X |
| 3,721,042 | 3/1973 | Marason, Jr. | 446/471 |
| 4,548,584 | 10/1985 | Townsend | 446/456 X |
| 4,580,994 | 4/1986 | Fauser et al. | 446/462 X |
| 4,776,415 | 10/1988 | Brice | 280/43.23 X |
| 5,322,469 | 6/1994 | Tilbor | 446/454 |

FOREIGN PATENT DOCUMENTS

| | | | |
|---|---|---|---|
| 2754036 | 2/1979 | Germany | 446/456 |
| 2852635 | 6/1979 | Germany | 446/456 |
| 3008604 | 9/1981 | Germany | 446/456 |
| 406327845 | 11/1994 | Japan | 446/456 |
| 3037569 | 7/1980 | United Kingdom | 446/466 |
| 2116052 | 9/1983 | United Kingdom | 446/462 |

*Primary Examiner*—Robert A. Hafer
*Assistant Examiner*—D. Neal Muir

[57] ABSTRACT

A radio controlled scale model of a low rider vehicle including a chassis and first and second axels supported on the chassis, a lift assembly includes the chassis being provided with guide structure for maintaining the transverse orientation of the front axle while allowing movement of the axle relative to the chassis within a plane perpendicular to the central longitudinal axis of the chassis. The lifting action is accomplished by a solenoid whose push rod presses on a pivotable "L" shaped lever arm which in turn presses on the front axle causing the chassis and attached vehicle body to rise when activated and fall when released simulating a low rider "hop". The power supply located in the trunk portion of the vehicle acts as a counter balance so that the front wheels lift easily. The rear wheels are independently driven by separate motors so that when both motors are activated the vehicle the vehicle moves in a straight direction and when either motor is activated independently the vehicle turns to the left or right. Continuous activation of either motor results in a spinning action of the vehicle.

6 Claims, 3 Drawing Sheets

COUNTER BALANCED LIFT ASSEMBLY FOR LOW-RIDER MODEL VEHICLES

BACKGROUND OF THE INVENTION

1. Field of Invention

The present invention relates generally to toys and, more particularly, to a scale model of a low rider vehicle having a counter balanced lift assembly for accurately simulating the hopping moves performed by actual low riders, and for creating a reversible spinning type movement for added play value.

2. Discussion of Prior Art

One of the many ways in which vehicles are customized by individuals include installation of hydraulic lift assemblies within the suspension systems provided on the vehicles for permitting the operator to alter the orientation of the vehicle relative to the wheels. Typically, the hydraulic set up in one of these "low rider" vehicles includes a hydraulic suspension system, hydraulic pumps, and a power source for creating the various observed movements. A favorite movement created is a hopping motion in which the front body portion of the vehicle bounces up and down in a controlled fashion.

Although it is known to construct scale models of low rider vehicles, and to customize these scale models by detailing them to appear similar to actual low riders, these models fail to provide actual simulation of low rider movements. Only one patent, U.S. Pat. No. 5,334,077 by Bailey Granted on Aug. 2, 1994 has attempted to duplicate Low rider movements. The Bailey design incorporates strings or other roll up members which are connected to the front and rear axles of a toy car. The axles are mounted in vertical slots allowing movement of the axle in a vertical direction. The strings are able to be rolled up by small electric motors which have pulleys mounted on their shafts. When power is provided to the motor the pulley winds up the string and causes tension on the string which in turn creates a lifting action to the front or rear axle. Although this method of raising and lowering the vehicle with respect to the wheels does provide an effect, it has certain weaknesses which include: the potential for the lifting string to break or become otherwise entangled, the inability for the vehicle to really "hop" meaning that the front wheels leave the ground, the relatively slow reaction time of the up and down motion due to the time needed to roll the string in and out, and the expense of the motors in producing an economical version of a low rider. Another drawback of the Bailey design is that it does not provide a means for easily steering the vehicle. Another drawback of the Bailey design is that the preferred embodiment shows a vehicle connected by an electric cable which makes it difficult to produce a spinning action.

OBJECTS AND SUMMARY OF THE INVENTION

It is an object of the present invention to provide a scale model of a low rider vehicle, wherein the model is capable of performing a realistic bouncing motion in the front portion of the vehicle. It is a further object of the present invention to provide a scale model of a low rider vehicle in which a rear weight counter balances the front of the vehicle in such a way that the front wheels can easily leave the ground when so activated. It is a further object of the present invention to provide a scale model of a low rider vehicle which is capable of a spinning motion. It is a further object of the present invention to provide a scale model of a low rider vehicle which is quickly capable of changing directions when being steered by an individual via a radio controlled transmitting device. In accordance with these and other objects, a model of a low rider vehicle includes a chassis and a front mounted axle supported on the chassis and fitted with a pair of wheels on which the front of the model is supported on the ground. The rear wheels are supported by independent shafts which radiate from gear reduction housings on either side of the rear of the vehicle. The chassis includes a guide means for maintaining the transverse orientation of the front axle while allowing movement of the axle relative to the chassis within a plane perpendicular to the central longitudinal axis of the chassis. A lifting means is provided for moving the chassis relative to the front axle between a lowered position and a raised position.

Preferably, the guide means includes a pair of laterally opposed side walls connected to the chassis, the side walls each being provided with a vertical slot through which the axle extends, the slots allowing rotation of the axle as well as vertical movement of the axle relative to the chassis within a plane perpendicular to the central longitudinal axis.

The lifting means preferably includes a solenoid centrally located on the chassis having a push rod which, when activated, moves in an outward direction toward the front of the vehicle. The push rod engages a pivotable lever arm which in turn pushes down the front axle causing the chassis to move upward with relation to the front wheels and ground. The extreme rear of the vehicle is counter weighted in such a way that relatively little force is required to cause the vehicle to lift. The momentum of the lifting action causes the front wheels to temporarily leave the ground in a similar manner to actual full scale low riders. While the wheels are off the ground the user may activate the left or fight rear drive motors and associated gear train causing the vehicle to turn quickly to the right or left or even to spin about the rear axle. By constructing a scale model in accordance with the present invention numerous advantages are realized. For example, a realistic front bouncing action that closely resembles that of a full scale low rider as well as the ability to make quick and therefore dramatic right and left turns while the vehicle is in motion as well complete spins.

DETAILED DESCRIPTION OF PREFERRED EMBODIMENT

Figure 1:
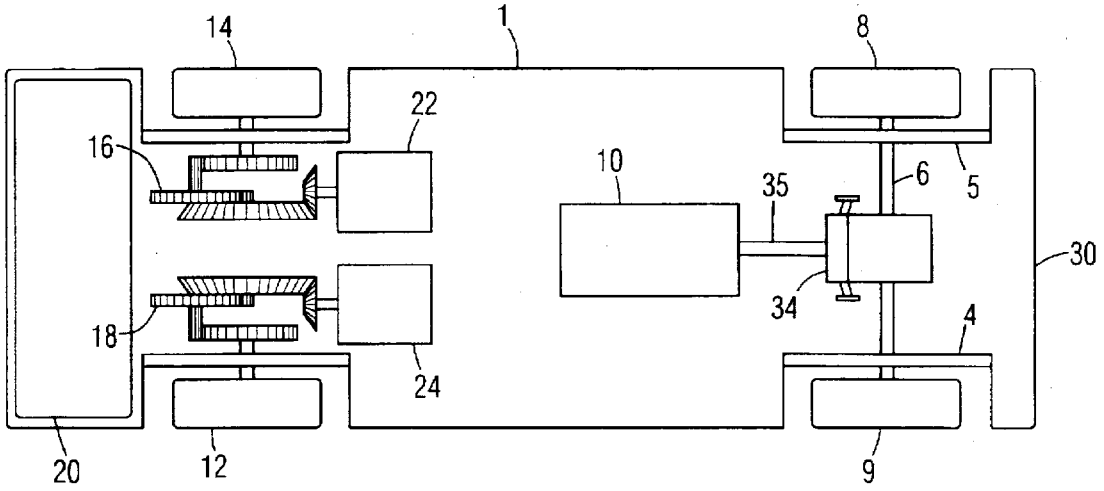
FIG. 1 is a top view of the model low rider of the present invention with outer housing removed.
Figure 2:
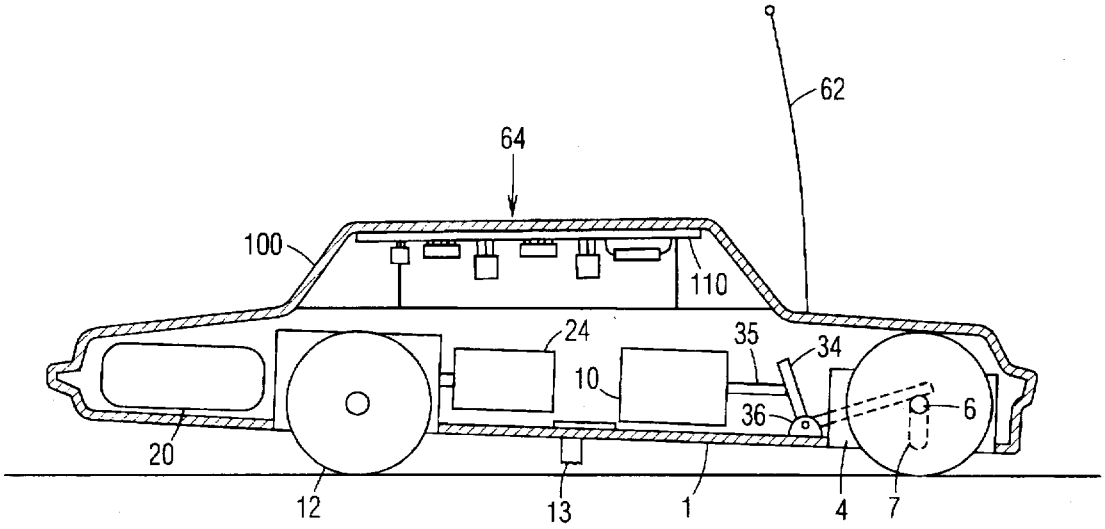
FIG. 2 is a side section view of the moved model low rider vehicle of the present invention with car in lowered position.
Figure 3:
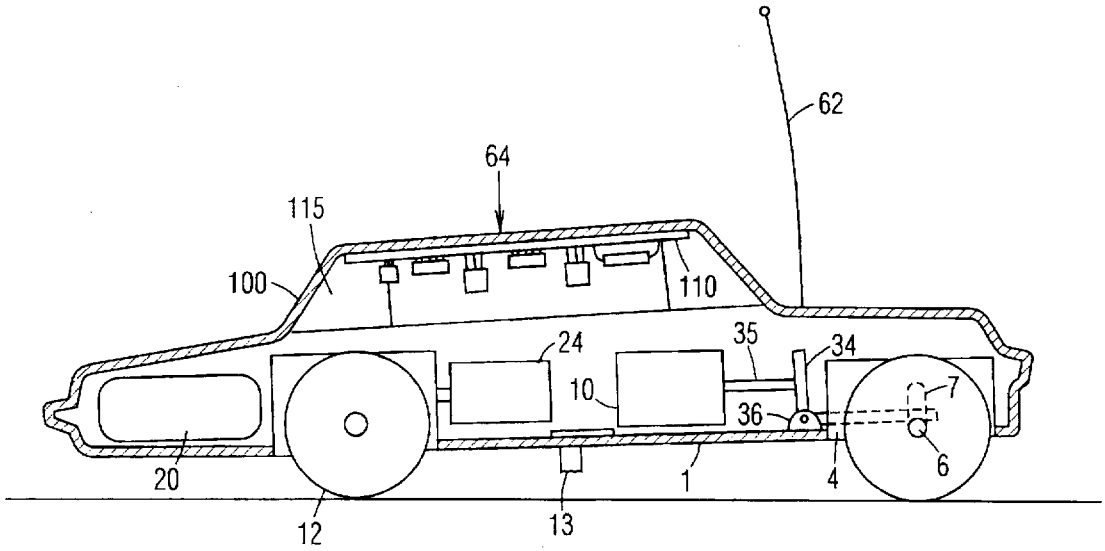
FIG. 3 is a side section of the model low rider vehicle of the present invention with front of car in raised position.

Referring to FIG. 1, car chassis 1 is supported by four wheels 6,8,12 &14. An axle 6 connects front wheels 8,9 near the front 30 of car. Rear wheels 12,14 are connected respectively to gear drive reduction drive mechanisms 16,18 which in turn are powered by drive motors 22,24. Drive motors 22, 24 are powered by D.C. battery pack 20. Battery pack also acts as a counter weight on front wheels 8,9. Solenoid 10 is mounted at the longitudinal center axis of the car and push rod 35 makes frictional contact with lever 34. FIG. 2 shows a side section view of the present invention. Front axle 6 is held in place by right angle flanges 4,5. Vertical slots 7 in flanges 4,5 allow axle 6 to slide up and down. Push rod 35 protrudes from solenoid 10 and touches the vertical arm of lever 34. The elbow of lever 34 pivots on axle 36. When solenoid 10 is activated, push rod 35 pushes against the vertical member of lever arm 34 causing the lever to pivot about axle 36 and in turn causing the horizontal member of the lever arm 34 to push down on axle 6 thereby causing the front of chassis 1 and attached car body 100 to rise with respect to the front wheels 8,9 and the ground as shown in FIG. 3 creating a bouncing effect as the solenoid 10 is repeatedly activated and deactivated. Battery pack 20 acts as a counter weight so that very little effort is needed for solenoid 10 to lift chassis 1 and attached car body 100.

Electronic receiver circuit 110 is mounted in the upper portion of car body 100 and hidden by tinted windows 115 which surround the upper portion of car body 100. Switch 13 turns on receiver circuit 110 which allows power from battery pack 20 to be supplied to drive motors 22,24 and solenoid 10 when appropriate signals are sent from remote control unit 200.

Figure 4:
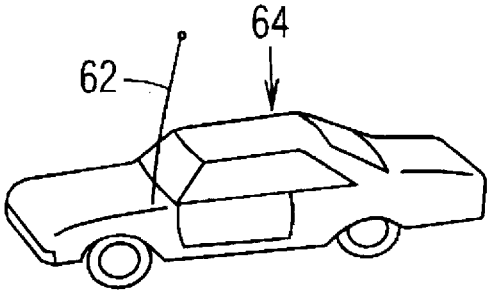
FIG. 4 is a perspective view of the model low rider toy vehicle.
Figure 5:
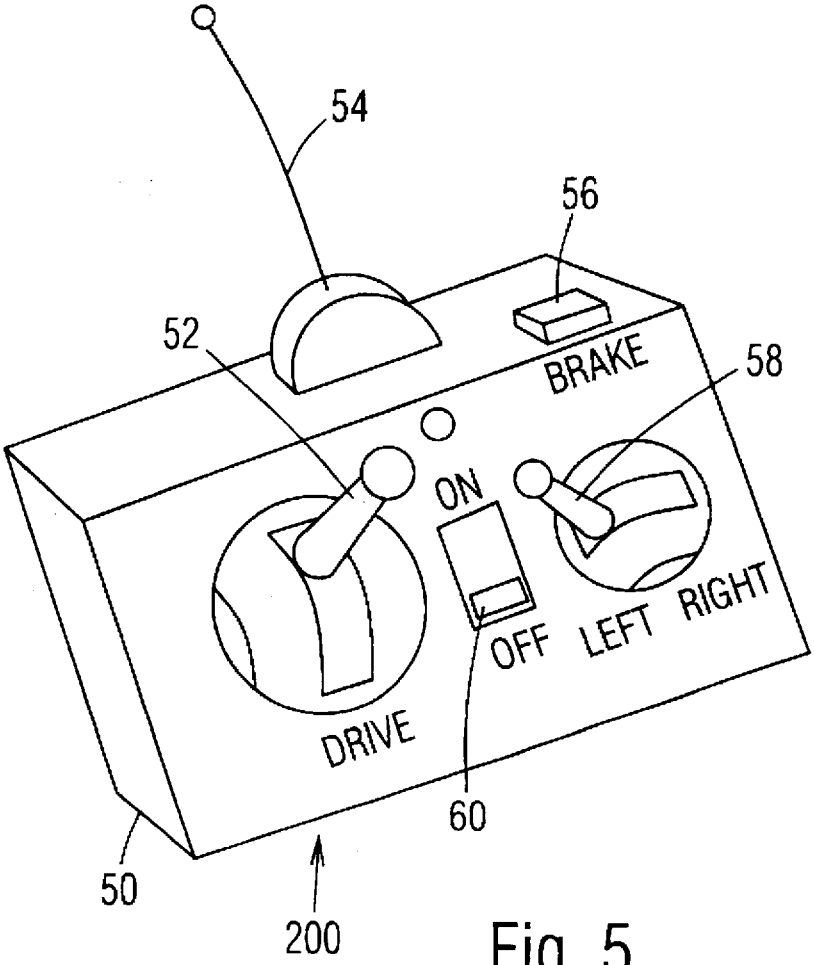
FIG. 5 is a perspective view of the remote controls for the low rider toy vehicle.

FIG. 4 shows the assembled low rider unit 64 and transmitter assembly 200. Antenna 54 on transmitter unit 200 transmits a signal to antenna 62 mounted on low rider vehicle 64. When push button 56 is pressed it activates solenoid 10 (FIG. 1) which causes the front of the model low rider vehicle of the present invention to rise as previously described. Joy stick 58 activates the left or right motor 22,24 as shown in FIG. 1. When joy stick 58 is pushed to the left the right drive motor 24 is activated causing the chassis 1 and attached car body 100 to pivot about the left wheel 14 and therefore turn to the left. Continuous activation of motor 24 causes the model low rider vehicle to spin, pivoting about wheel 14. Because there are no external wires connected to the model vehicle the model vehicle can spin freely. Similarly, when joy stick 58 is moved to the right, a signal is transmitted to the model low rider vehicle of the present invention causing the left side motor 22 to activate which in turn causes the model vehicle to pivot about the right wheel 12. Moving joy stick 52 forward causes both drive motors 22,24 to be activated in a clockwise direction to be activated in a clockwise direction causing the car to move straight ahead. Moving the joy stick 52 backward causes the polarity on motors 22, 24 to be reversed which drives the rear wheels 12,14 of the model low rider vehicle in a backward direction. Switch 60 turns the transmitter on and off.

Although the invention has been described with reference to the preferred embodiment illustrated in the attached drawing figures, it is noted that substitutions may be made and equivalents employed herein without departing from the scope of the invention as recited in the claims.

What is claimed is:

1. A low-rider model vehicle, comprising:

a chassis having a longitudinal axis, a front end, and a rear end;

front and rear axles respectively supported on said chassis adjacent said front end and said rear end thereof, each of said axles extending in a transverse direction relative to said central longitudinal axis;

a pair of wheels attached to each of said axles and adapted to support said vehicle on a ground;

guide means for maintaining said transverse direction of said front axle and allowing movement of said front axle relative to said chassis along a plane normal to said central longitudinal axis, said guide means comprising a pair of laterally opposed vertical side walls connected to said chassis, each of said side walls being provided with a vertical slot, said front axle extending through said slots, said slots allowing rotation and vertical movement of said front axle relative to said chassis along said plane;

lifting means for moving said chassis relative to said front axle between a lowered position and a raised position, said lifting means comprising an electric solenoid having a horizontal push rod extending from one end thereof toward said front end of said chassis, said push rod being mounted along said longitudinal axis;

a power supply connected to said electric solenoid for activating said electric solenoid; and a L-shaped lever arm having an elbow pivotally attached to said chassis adjacent said push rod, said L-shaped lever arm having a horizontal portion and a vertical portion, said horizontal portion being attached to said front axle, said vertical portion engaging said push rod, when said solenoid is activated by said power supply, said push rod is extended to rotate said L-shaped lever arm, said horizontal portion of said L-shaped lever arm rotating downwardly, so that said front axle is lowered relative to said chassis, and said front end of said chassis is adapted to be raised relative to said ground.

2. The low-rider model vehicle of claim 1, wherein said power supply is positioned in a rearmost portion of said chassis, so as to serve as a counterweight and facilitating raising said front end of said chassis.

3. The low-rider model vehicle of claim 1, further including a motor and a reduction drive mechanism for powering each of said wheels attached to said rear axle.

4. The low-rider model vehicle of claim 3, wherein said motor and said reduction drive mechanism can be selectively activated for rotating said pair of wheels on said rear axle in a similar or an opposite direction for forward or turning motion, respectively.

5. The low-rider model vehicle of claim 1, further including transmitter means for remotely operating said vehicle.

6. The low-rider model vehicle of claim 1, further including a receiver circuit cooperating with said transmitter means.

* * * * *